United States Patent [19]

Taylor

[11] Patent Number: 5,003,744

[45] Date of Patent: Apr. 2, 1991

[54] GLASS-BLOCK PANELS WITH IMPROVED THERMAL CONDUCTION CHARACTERISTICS

[75] Inventor: John R. Taylor, Irving, Tex.

[73] Assignee: Innovative Building Products, Inc., Grand Prairie, Tex.

[21] Appl. No.: 387,229

[22] Filed: Jul. 31, 1989

[51] Int. Cl.[5] ..... E04C 1/42

[52] U.S. Cl. ..... 52/308; 52/668

[58] Field of Search ..... 52/307, 308, 732, 668, 52/488

[56] References Cited

U.S. PATENT DOCUMENTS 2,199,244 4/1940 Mulford ..... 52/307

3,525,189 8/1970 Nelsson ..... 52/732 X

*Primary Examiner*—David A. Scherbel

*Assistant Examiner*—Jerrold D. Johnson

*Attorney, Agent, or Firm*—Kenneth R. Glaser

[57] ABSTRACT

A glass block panel construction and method of fabrication useful for decorative and functional purposes. The panel includes a frame rigidly assembled from interlocking components to form a grid-like pattern of adjacent pockets, each pocket sized to receive and support a glass block by way of support lips extending around each pocket, the blocks bonded to the frame and therefore to one another in structurally stable and weather sealed relation. Improved thermal condition characteristics are provided by serpentine thermal conduction paths through members of the frame.

5 Claims, 2 Drawing Sheets

GLASS-BLOCK PANELS WITH IMPROVED THERMAL CONDUCTION CHARACTERISTICS

TECHNICAL FIELD

The field of art to which the invention pertains comprises the art of building construction utilizing glass blocks installed as panels for decorative and/or functional purposes, such as windows, skylight, and the like.

BACKGROUND OF THE INVENTION

Glass blocks or "bricks" have been widely used in the domestic and commercial building trades for several decades. When installed, the blocks are commonly clustered in a panel in various distinctive geometric patterns, the panel being disposed within a wall formed of conventional brick, block or framing. Their aesthetic attractiveness has been a major factor contributing toward their enduring popularity for both interior and exterior walls. In addition, by virtue of their translucence, the glass blocks effectively serve as windows for transmission of daylight.

Improved glass block panel constructions are the subject of my U.S. patent application, Ser. No. 07/236,169, filed Aug. 25, 1988, abandoned in favor of continuation application Ser. No. 7/368,120, filed July 31, 1989 the disclosure of which is incorporated herein by reference. It has been found, however, that aluminum frame members used in the preferred embodiment of my glass-block panel constructions have a tendency to readily conduct heat, thereby effecting building heating and cooling efficiency where panels are used between the exterior and interior of air-conditioned buildings. Therefore, a need presently exists for means to improve the thermal conduction characteristics of glass-block panels.

SUMMARY OF THE INVENTION

The present invention relates to a construction of glass blocks in a novel assembled panel relation which provides individual support for each block of the panel, and affords improved thermal conduction characteristics of the installed panel. The foregoing is achieved in accordance with the invention by means of a frame formed of transversely intersecting, interlocking partition bars in cooperation with a peripheral border, providing a matrix support for the array of glass blocks At least one row of thermal break slots is provided in at least some of the partition bars, thereby providing serpentine paths for the conduction of heat through the partition bars.

DESCRIPTION OF PREFERRED EMBODIMENT

Figure 1:
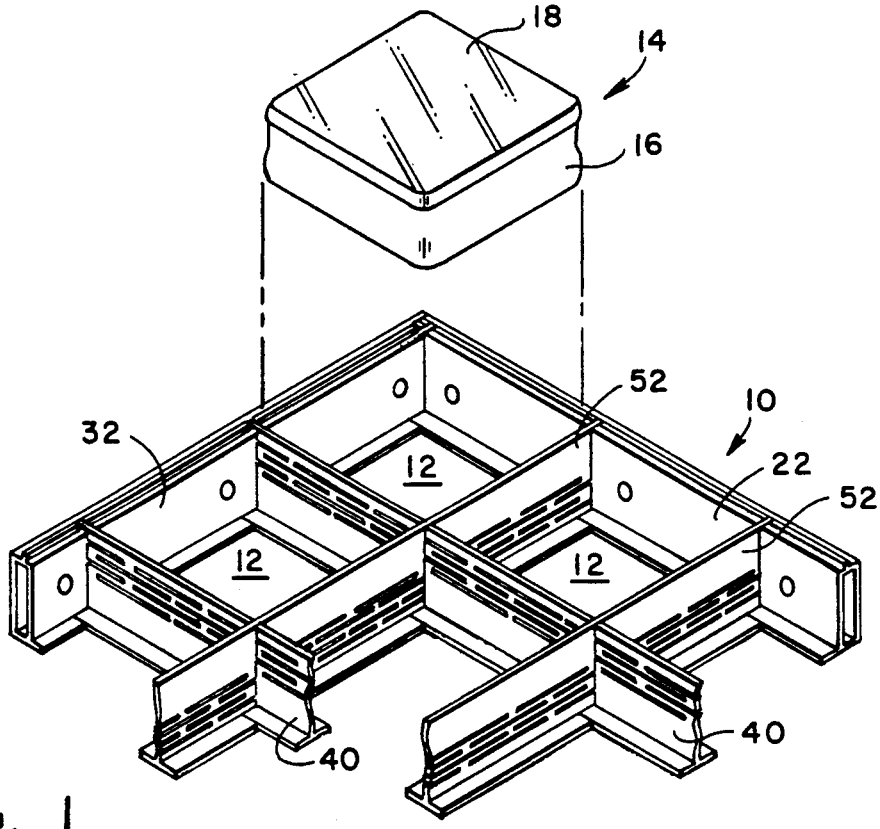
FIG. 1 is a partial topside isometric view of the support frame for assembling a glass block panel in accordance with the invention.

In the description which follows, like parts are marked throughout the specification and drawings with the same reference numerals respectively. The drawing figures are not necessarily to scale and the proportions of certain parts may have been exaggerated for purposes of clarity.

Figure 2:
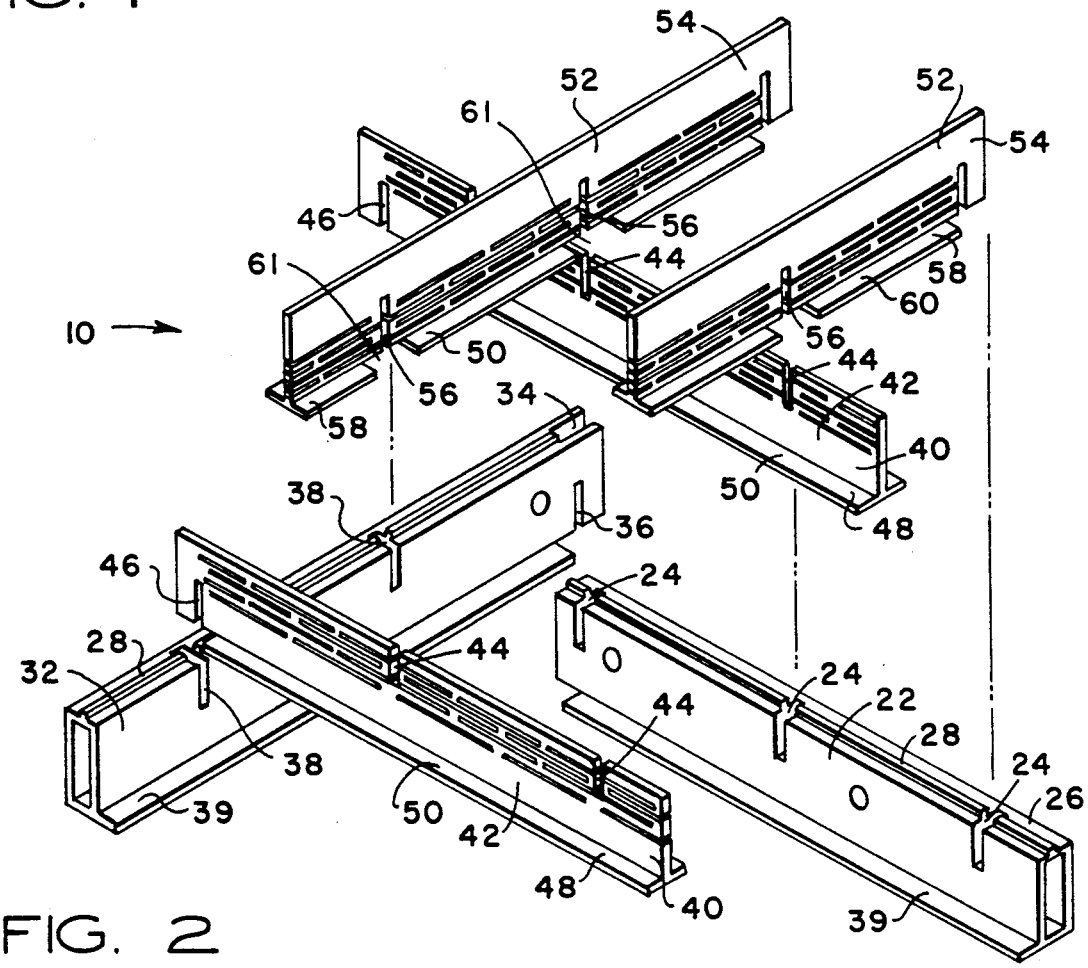
FIG. 2 is a fragmentary enlargement of the frame of FIG. 1 with the frame components illustrated in an exploded relation.

Referring initially to FIGS. 1 and 2, there is now described the fabrication of a glass block panel in accordance with the invention, in this example for a window assembly. Accordingly, this fabrication is effected by first forming a tray-like grid pattern support frame, designated in the drawing by the reference numeral 10, of suitable dimension and configuration corresponding to the panel desired to be constructed. The completed support frame defines a plurality of matrix clustered adjacently disposed pockets 12, each pocket dimensioned so as to closely receive a glass block 14 of known dimension which is suitably inserted front-to back therein.

Glass block 14 (FIG. 1) is of the conventional type available from various commercial sources, such as Pittsburgh-Corning, in a variety of different sizes and shapes. For the purpose subsequently described, a resilient stabilizing ring 16 formed of self stick closed-cell vinyl foam, for example, may be placed in a ribbon wrap encircling the glass block at the intersection of the sloping sides and at an intermediate location between the front face 18 and wrapping around the rear face thereof.

Frame 10, which can be prefabricated before transport to the installation site or constructed on-site, as desired, comprises a plurality of transversely intersecting members 40 and 52, preferably of metal, surrounded by perimeter frame members 22 and 32, the entire assembly being so constructed to preferably interfit together to form the matrix of pockets 12 in which the glass blocks 14 are to be supported.

In the preferred embodiment, the transversely intersecting members of the frame forming the grid configuration are prefabricated of longitudinal partition bars adapted to effect a rigid and sturdy mechanical interlock with one another and with the surrounding perimeter members. The perimeter members 22 and 32 form a peripheral border about the assembly to cooperate internally with the partition bars (40, 52) in defining pockets 12 for supporting the inserted blocks 14. About its exterior, the perimeter bars abut an opening in the intended wall structure with which the panel is adapted to be installed.

More specifically, the periphery of the frame 10 comprises a first pair cf interchangeable parallel longitudinal, perimeter bars 22, preferably tubular and of rectangular cross section, each bar 22 having a plurality of longitudinally spaced vertical slots 24 opening downwardly from the top surface 26. Longitudinal ridges 28 are formed at the top surface 26 between the slots 24.

For transverse joinder with bars 22 to form the frame periphery, there is also provided a second pair of interchangeable longitudinal, and preferably tubular, perimeter bars 32, each bar 32 including at its ends an internal recess 34 in a bifurcated U-shaped formation. In a manner similar to that described with respect to perimeter bars 22, longitudinal ridges 28 are also formed at the top surface of bars 32 for intersection with the ridge 28 on bars 22, thus forming a circumferential ridge around the periphery of the assembled frame.

Near each end of the bar 32, vertical underslots 36 are provided to cooperate and interfit with end slots 24 of bars 22 to effect a mechanical joinder therewith, while vertical slots 38 are provided at the top surface of each bar 32 to receive the transverse partition bars 40, as will be subsequently described.

Each of the perimeter bars (22, 32) includes a longitudinally extending, lateral lip 39 at its base adapted to protrude inward of the defined pockets 12, thereby essentially defining a shelf support upon which each inserted glass block 14 can sit.

For forming the grid-like pattern defining the plurality of individual recessed pockets 12, a plurality of first partition bars 40 are provided, each bar 40 being formed of a longitudinal flat stock member 42 with a transverse flange 48. Bars 40 extend parallel to, and intermediate, spaced perimeter bars 22 and are adapted to be connected with perimeter bars 32.

Each partition bar 40 has a plurality of longitudinally spaced vertical slots 44 extending downwardly from, and open at, its upper edge with underside vertical slots 46 being provided at each end for interlocking with the slots 38 of perimeter bars 32. Flange 48 provides dual lateral shelf lips 50 on each side of the flat member 42 so that when partition bar 40 is connected to perimeter bar 32, the lips 50 are coplanar with lips 39.

Adapted to transversely intersect, and be connected with the partition bars 40 and the perimeter bars 22 are a second plurality of partition bars 52 extending parallel to and intermediate spaced perimeter bars 32. Partition bars 52, like bars 40, are formed of flat stock 54 and include a plurality of spaced apart vertical underslots 56 adapted to cooperate and interfit with slots 24 of perimeter bars 22 and slots 44 of partition bars 40, in effecting a mechanical gridlock therewith.

Extending along the underside of bar 52 are transverse flanges 58 which define dual sided lateral lips 60 separated by interruptions 61. As before, when partition bars 52 are fitted together with perimeter bars 22 and transverse bars 40, the lips 60 are coplanar with lips 39, 50, and 60 thus defining a common shelf-lip support plane within, and around the circumference of, each of the pockets 12 defined by the frame.

Figure 3:
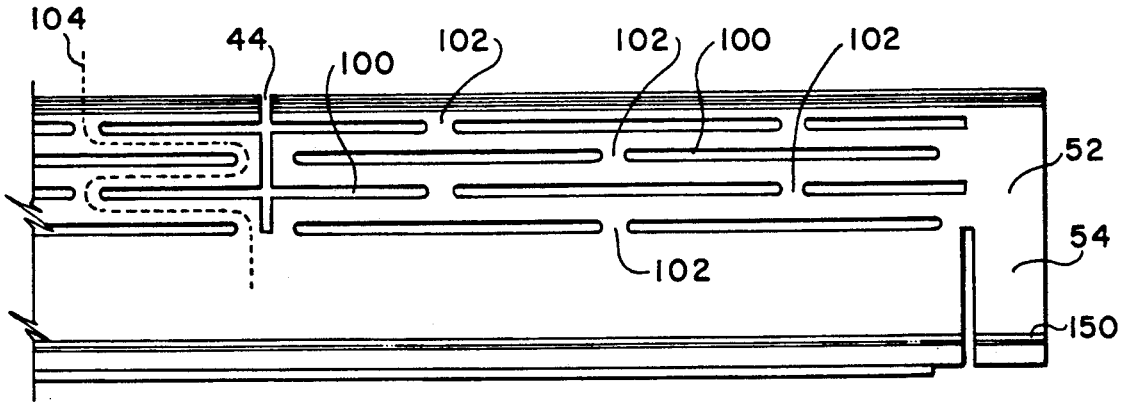
FIG. 3 is a side view of a first type of partition bar.
Figure 4:
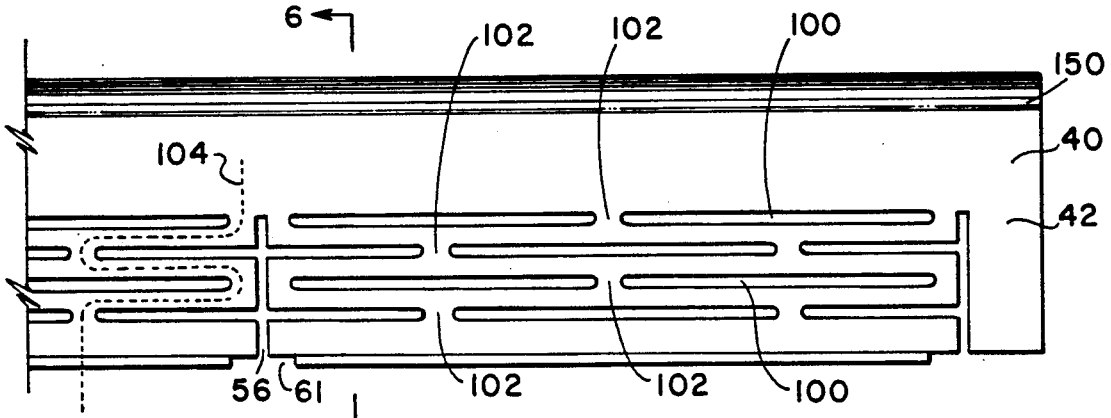
FIG. 4 is a side view of a second type of partition bar.

Improved thermal conduction characteristics result from the provision of thermal break slots in the flat stock members 42 and 54, as best shown in FIGS. 3 and 4, which illustrate partition bars 40 and 52 in greater detail. Specifically, at least some, and preferably all, of the partition bars 40 and 52 include at least one row of thermal break slots 100 in flat stock members 42 and 54. While the provision of only one thermal break slot 100 would advantageously improve thermal conduction, in the preferred embodiment, a plurality of rows of thermal break slots are provided as shown. The thermal break slots 100 are spaced in each row with gaps 102 between adjacent ones of the thermal break slots 100.

Figure 5:
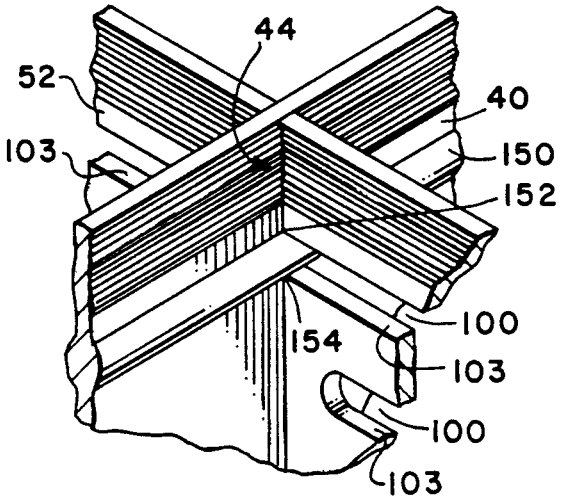
FIG. 5 is a partial isometric view of an intersection of partition bars.
Figure 6:
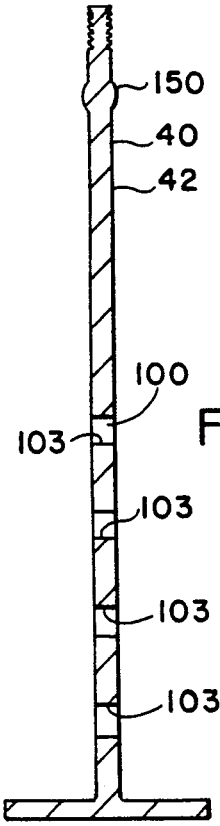
FIG. 6 is a sectional view taken along lines 6—6 of FIG. 4.

Each of the thermal break slots 100 is long in a horizontal dimension, as shown in FIGS. 3 and 4. As best shown in FIGS. 5 and 6, the thermal break slots 100 are defined by walls 103 extending between the opposite sides of the flat stock members 42 and 54. The rows of thermal break slots 100 are spaced vertically, as shown. The gaps 102 are staggered vertically between adjacent rows of thermal break slots 100, such that serpentine paths, as illustrated by lines 104, are provided to lengthen the path of thermal conduction through each partition bar. Because the ability to conduct heat energy is directly related to the length of the path of conduction, the thermal conduction characteristics of partition bars 40 and 52 is significantly improved.

Another feature of the invention involves the enhanced rigidity provided by cooperation between certain ones of the thermal break slots 100 and longitudinal ribs 150 formed in flat stock members 42 and 54. Referring now to FIGS. 5 and 6 in addition to FIGS. 3 and 4, it can be seen that partition bars 52 each include a longitudinal rib 150 located in the lower vertical half of flat stock number 54. Similarly, each of the partition bars 40 includes a longitudinal rib 150 located in the upper vertical half of flat stock member 42. The thermal break slots 100 are located in the upper vertical half of flat stock number 54 of partition bars 52, whereas the thermal break slots 100 in partition bars 40 are located in the lower vertical half of flat stock member 42. Vertical slots 44 in partition bars 52 intersect thermal break slots 100, and similarly, vertical underslots 56 intersect thermal break slots 100 in partition bars 40. Thus, as best shown in FIG. 5, opposing corners 152 and 154 of vertical slot 44 and a thermal break slot 100 grip longitudinal rib 150 on partition bar 40. In identical fashion, opposing corners of one of the thermal break slots 100 and a vertical underslot 56 grip longitudinal ribs 150 on the lower vertical half of each partition bar 52. The gripping feature provided by the longitudinal ribs and the vertical slots and underslots allows for a substantial enhancement in the vertical stability of the grid during assembly. Of course, once the entire grid is assembled, including the glass blocks, additional structural integrity is afforded by other corresponding parts of the assembly. However, during construction and before the glass blocks are inserted, the impedance of relative vertical motion between the partition bars provided by the horizontal ribs and vertical slots and underslots enables the temporary structural integrity required to efficiently assemble the unit during the assembly process.

Although a preferred embodiment of the invention has been described in detail, it is to be understood that various changes, substitutions, and alterations can be made thereto without departing from the spirit and scope of the invention as defined by the appended claims.

I claim:

1. A glass-block panel, comprising:

a perimeter formed from first and second pairs of interchangeable parallel longitudinal perimeter bars interlocked at ends thereof to form a peripheral border;

said perimeter bars each having a tubular rectangular cross-section including a top surface and a base, a plurality of longitudinally spaced vertical slots opening downwardly from said top surface, a longitudinal ridge formed at said top surface between said vertical slots, and a longitudinally extending lateral lip at said base protruding inwardly therefrom;

each of said first pair of said perimeter bars having end slots, said end slots being ones of said vertical slots located in close proximity to said ends thereof of said first pair of perimeter bars;

each of said second pair of said perimeter bars having internal recesses of bifurcated U-shaped formation at said ends thereof, with vertical underslots provided at each of said internal recesses for interfitting engagement with said end slots of said first pair of perimeter bars;

first and second pluralities of partition bars in cooperation with said peripheral border, said first plurality of partition bars extending parallel to and intermediate said first pair of perimeter bars, and said second plurality of partition bars extending parallel to and intermediate said second pair of perimeter bars, to form a grid-like pattern defining a plurality of individual recessed pockets;

each said partition bar including a longitudinal flat stock member, an upper edge, a transverse flange, and two ends, with said flange providing dual lateral shelf lips on each side of said flat stock member;

each of said first plurality of partition bars having a plurality of longitudinally spaced vertical slots extending downwardly from, and open at, said upper edge, and having an underside vertical slot at each of said ends interlocked with one of said slots of said second pair of perimeter bars;

each of said second plurality of partition bars having a plurality of spaced apart underside vertical slots interfitted with said vertical slots of said first plurality of partition bars, and having an underside vertical slot at each of said ends interlocked with one of said slots of said first pair of perimeter bars;

each of said first and second pluralities of partition bars including a plurality of walls defining rows of elongated thermal break slots in said flat stock members, said thermal break slots being spaced horizontally in each said row with gaps between adjacent ones thereof, said thermal break slots being long in a horizontal dimension, with said rows being spaced vertically and with said gaps being staggered vertically between adjacent rows of said slots;

said lips of said perimeter and partition bars being coplanar and defining a common shelf lip support plane within each of said pockets; and a rectangular glass block inserted into each said pocket in contact with said shelf lips, with at least one compressed resilient stabilizing ring gasket interfitted between each said glass block and each said pocket to seal and stabilize said glass block within said pocket.

2. A glass-block panel, comprising:

first and second pluralities of partition bars in cooperation with a peripheral border to form a grid-like pattern defining a plurality of individual recessed pockets, said first plurality of partition bars intersecting said second plurality of partition bars;

each said partition bar including a longitudinal flat stock member;

said partition bars including a plurality of walls defining at least one row of thermal break slots in said flat stock members, said thermal break slots being spaced in said row with gaps between adjacent ones thereof;

the thermal break slots in said first plurality of partition bars being located in the upper vertical half of said flat stock members, and said thermal break slots in said second plurality of partition bars being located in the lower vertical half of said flat stock members; and a rectangular glass block inserted into each said pocket.

3. The glass-block panel of claim 2 further comprising:

said first plurality of partition bars each including a longitudinal rib located in the lower vertical half of said flat stock member and a plurality of vertical slots intersecting said thermal break slot;

said second plurality of partition bars each including a longitudinal rib located in the upper vertical half of said flat stock member and a plurality of vertical underslots intersecting said thermal break slot;

said first and second pluralities of partition bars intersecting at said vertical slots and underslots; and opposing corners of said thermal break slots and said vertical slots and underslots gripping said longitudinal ribs on said partition bars, such that relative vertical motion between said first and second pluralities of partition bars is impeded.

4. A glass-block panel support frame comprising:

first and second pluralities of partition bars in cooperation with a peripheral border to form a grid-like pattern defining a plurality of individual recessed pockets for supporting respective glass blocks, said first plurality of partition bars intersecting said second plurality of partition bars;

said partition bars having thermal break slots defined therein;

wherein the major portion of said thermal break slots in said first plurality of partition bars are located in the upper vertical half thereof, and the major portion of said thermal break slots in said second plurality of partition bars are located in the lower vertical half thereof.

5. The panel as defined in claim 4 wherein all of said thermal break slots in said first plurality of partition bars are located in the upper vertical half thereof, and all of said thermal break slots in said second plurality of partition bars are located in the lower vertical half thereof.

* * * * *

UNITED STATES PATENT AND TRADEMARK OFFICE

CERTIFICATE OF CORRECTION

PATENT NO. : 5,003,744

DATED : April 2, 1991

INVENTOR(S) : John R. Taylor

It is certified that error appears in the above-identified patent and that said Letters Patent is hereby corrected as shown below:

Column 4, line 61, delete the word "thereof".

Signed and Sealed this

Twenty-fifth Day of August, 1992

*Attest:*

DOUGLAS B. COMER

*Attesting Officer*

*Acting Commissioner of Patents and Trademarks*